US008264173B2

(12) United States Patent
Bertozzi et al.

(10) Patent No.: US 8,264,173 B2
(45) Date of Patent: Sep. 11, 2012

(54) METHODS AND SYSTEMS FOR ACCELERATING PARTICLES USING INDUCTION TO GENERATE AN ELECTRIC FIELD WITH A LOCALIZED CURL

(75) Inventors: William Bertozzi, Lexington, MA (US); Stephen E. Korbly, Acton, MA (US); Robert J. Ledoux, Harvard, MA (US)

(73) Assignee: Passport Systems, Inc., Billerica, MA (US)

( * ) Notice: Subject to any disclaimer, the term of this patent is extended or adjusted under 35 U.S.C. 154(b) by 707 days.

(21) Appl. No.: 12/351,234

(22) Filed: Jan. 9, 2009

(65) Prior Publication Data

US 2009/0174509 A1 Jul. 9, 2009

Related U.S. Application Data

(60) Provisional application No. 61/019,944, filed on Jan. 9, 2008.

(51) Int. Cl.
*H01J 23/00* (2006.01)

(52) U.S. Cl. ..... 315/500; 315/501; 315/506

(58) Field of Classification Search ..... 315/500–507
See application file for complete search history.

(56) References Cited

U.S. PATENT DOCUMENTS

| | | | | |
|---|---|---|---|---|
| 2,394,070 | A * | 2/1946 | Kerst | 315/504 |
| 3,742,212 | A | 6/1973 | McIver, Jr. | |
| 4,381,450 | A | 4/1983 | Cappelli | |
| 4,751,978 | A | 6/1988 | Drutchas et al. | |
| 5,122,662 | A * | 6/1992 | Chen et al. | 250/269.3 |
| 5,280,252 | A | 1/1994 | Inoue et al. | |
| 5,436,537 | A | 7/1995 | Hiramoto et al. | |
| 5,698,954 | A | 12/1997 | Hirota et al. | |
| 5,783,914 | A | 7/1998 | Hiramoto et al. | |
| 6,201,851 | B1 | 3/2001 | Piestrup et al. | |
| 6,462,490 | B1 | 10/2002 | Matsuda et al. | |
| 6,713,976 | B1 * | 3/2004 | Zumoto et al. | 315/500 |
| 6,791,097 | B2 | 9/2004 | Scheuer et al. | |
| 6,856,105 | B2 | 2/2005 | Yao et al. | |
| 6,914,396 | B1 * | 7/2005 | Symons et al. | 315/500 |
| 7,122,978 | B2 | 10/2006 | Nakanishi et al. | |
| 7,259,529 | B2 * | 8/2007 | Tanaka | 315/501 |
| 7,755,305 | B2 | 7/2010 | Umezawa et al. | |

(Continued)

FOREIGN PATENT DOCUMENTS

GB 1039137 8/1966

OTHER PUBLICATIONS

International Search Report and Written Opinion for PCT/US2009/030587. International Search Report and Written Opinion for PCT/US2009/032651.

(Continued)

*Primary Examiner* — James H Cho
(74) *Attorney, Agent, or Firm* — Foley Hoag LLP

(57) ABSTRACT

A method is described wherein the acceleration of a beam of charged particles is achieved using the properties of conductors to limit the penetration of magnetic and electric fields in short times compared to natural time constants. This allows the use of induction electric fields with a Curl localized to a gap to accelerate particles while coupling the accelerated beam to a power supply. Two methods of coupling the particle beam to the power supply are disclosed as exemplary.

13 Claims, 3 Drawing Sheets

U.S. PATENT DOCUMENTS

| | | | |
|---|---|---|---|
| 7,838,855 | B2 | 11/2010 | Fujii et al. |
| 2001/0040220 | A1 | 11/2001 | Pedersen et al. |
| 2002/0008450 | A1 | 1/2002 | Tanaka |
| 2005/0231138 | A1 | 10/2005 | Nakanishi et al. |
| 2007/0001128 | A1 | 1/2007 | Sliski et al. |
| 2007/0115071 | A1 | 5/2007 | Barov |
| 2007/0297565 | A1 | 12/2007 | Wofford et al. |

OTHER PUBLICATIONS

International Search Report and Written Opinion for PCT/US2009/030589.

Lord et al, *A Diagnostic System for Optimization of the External Beam Quality of the Oak Ridge Isochronous Cyclotron*, Jun. 1967, IEEE Transaction on Nuclear Science, pp. 1151-1154.

* cited by examiner

METHODS AND SYSTEMS FOR ACCELERATING PARTICLES USING INDUCTION TO GENERATE AN ELECTRIC FIELD WITH A LOCALIZED CURL

CROSS-REFERENCE TO RELATED APPLICATION

This present application claims priority to and the benefit of U.S. Provisional Patent Application Ser. No. 61/019,944 entitled "Method for Accelerating Particles Using Induction to Generate an Electric Field with a Curl Localized at a Gap" which was filed on Jan. 9, 2008 by William Bertozzi, Stephen E. Korbly and Robert J. Ledoux, and which is hereby incorporated by reference.

FIELD

A novel method and apparatus for accelerating a charged particle beam to a desired energy is disclosed. The accelerator and the methods can be used to accelerate any type of charged particle to form an energetic beam. One example of an application is to accelerate a beam of electrons which in turn may be used to produce an intense photon beam through the bremsstrahlung process.

BACKGROUND

Particle accelerators generally are grouped into different categories according to their fundamental concepts:

1) Those that use constant electrostatic fields such as Van de Graaff accelerators;

2) Those that make use of radiofrequency cavities in a straight line such as linear accelerators;

3) Those that use the electric fields induced by a time varying magnetic field to accelerate a particle such as the betatron; and 4) Circular accelerators that recirculate the beam of particles through a radiofrequency cavity to reach a desired energy such as a cyclotron, synchrotron, microtron, racetrack microtron or Rhodotron™.

Different names have been used to describe different combinations of the ideas represented by these groups and the concepts they represent as they have been perceived to be advantageous in different applications. Many are discussed in books about accelerator design such as M. S. Livingston and J. P. Blewett, "*Particle Accelerators*", McGraw Hill Book Company, Inc., New York, 1962. They all apply the fundamental Maxwell equations and particle dynamics in magnetic and electric fields to accelerate particles and form accelerated beams.

SUMMARY

The accelerator and associated methods disclosed herein also use the governing rules of Maxwell's equations, but in a novel approach that cannot be equated with any of the concepts or applications of the conventional particle accelerator groups listed above. The essential elements of this accelerator are:

1) A magnetic core that can accommodate a time varying B-field;

2) A power supply that can provide suitable voltages and currents.

3) An electrically conductive vacuum chamber that encircles a portion of the magnetic core and that has a non-conducting gap; and 4) A magnetic guide field to guide the particles around the interior of the vacuum chamber in stable orbits as they gain energy.

According to the methods and systems described in detail hereinbelow, any charged particle can be accelerated, and any energy within wide limits is possible, the limits being imposed only by the practical limits of the state-of-the-art for electrical insulation, power supply capabilities, magnets, etc. The method achieves large beam currents at high duty cycles approaching 100%. No radio frequency power generators feeding tuned cavities are required. A voltage supply may provide the energy to the beam. Energy is delivered to the particles via coupling to an electric field that possesses a Curl at a gap.

The type of accelerator disclosed herein is different from the accelerator classes mentioned above. Compared to 1) no static electric field with a divergence is used for acceleration, thus high energies can be achieved without extreme voltages. Compared to 2) and unlike a Linac, high radiofrequency electromagnetic fields in tuned cavities are not required to achieve high energies. The electron beam need not be bunched matching the RF fields in the cavities for acceleration. Compared to 3), the induction core with its time varying magnetic field is used to provide a self inductance that allows a voltage across the insulated accelerating gap to be maintained by a power supply with relatively low currents from the driving power supply. Since the acceleration cycle occurs in a time that is short compared to L/R, (where the self inductance of the accelerating chamber is L and R is the resistive impedance of the accelerating chamber and the power supply system), the accelerating electric field at the insulating gap possesses a curl and allows cumulative acceleration on successive turns in an acceleration chamber. Also, unlike the betatron example used in 3), the magnetic fields that guide the beam in orbits enclosing the induction core are static whereas, in the betatron, the fields that guide the beam are time varying and strictly related to the instantaneous magnetic field in the induction core. Compared to 4), there are no RF power supplies feeding tuned RF cavities and there are no bunched beams synchronized to the RF frequency to achieve acceleration. As mentioned above and as will be discussed later, the maximum length of time for an acceleration cycle for the accelerator disclosed herein is limited only by L/R. This time is typically many microseconds to milliseconds.

DETAILED DESCRIPTION OF EMBODIMENTS

The embodiments described herein are exemplary of the possible applications of the technology and methods disclosed herein for the acceleration of charged particles. Those experienced in the art will recognize that there are extensions, modifications and other arrangements of the important elements disclosed that can be implemented and they are intended to be encompassed within the scope of this disclosure.

For a better understanding of the present disclosure together with other and further objects thereof, reference is made to the accompanying drawings and the following detailed descriptions of selected embodiments.

Figure 1:
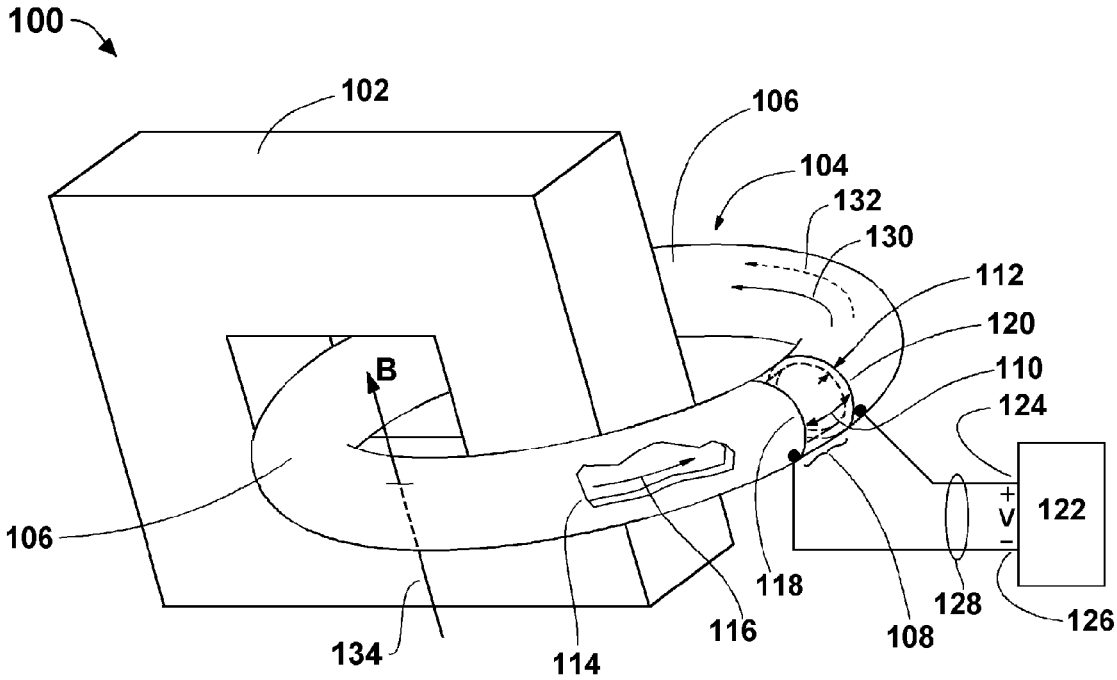
FIG. 1 shows one embodiment with the power supply disposed across the non-conducting gap of the vacuum chamber.

FIG. 1 is a schematic 100 of an embodiment of the methods and systems disclosed herein. A vacuum chamber 104 serves as a beamline and has an electrically conductive portion 106 and an electrically non-conductive portion that will be referred to as non-conducting gap 108. The vacuum chamber 104 may be generally tubular in cross-section (circular or rectangular, or other cross section) and may be toroidal in form, such as the circularly annular form illustrated, or may have some other closed path connection that permits cyclic/circulating passage of a beam within. A cutaway 114 provides a view of a beam of charged particles 116 cycling within the vacuum chamber 104. The beam 116 is for example (not limitation) an electron beam and has one or more electrons moving, for example, in the direction indicated by the arrow. (The cutaway 114 is for illustrative purposes only and does not represent an actual opening in the vacuum chamber 104.) The non-conducting gap 108 has a gap length d 110. The conductive portion 106 of the vacuum chamber 104 has a wall thickness w 112. A magnetic guide field 134 is a B-field and guides beam particles in the beam 116 through the vacuum chamber 104 along stable cyclic paths. The magnetic guide field 134 is only indicated schematically as a single flux line, but it is recognized that the magnetic guide field may be complex, may be generated by multiple magnetic elements (not shown) and may pass through multiple or all parts of the vacuum chamber 104 to effectively guide and/or focus the beam 116. The vacuum chamber 104 surrounds a portion of an induction core 102. The conductive portion 106 of the vacuum chamber 104 has two ends 118, 120 that are separated by the non-conducting gap 108. The joints between the ends 118 and 120 of the conducting portion 106 and the non-conducting gap 108 portion are sealed by conventional vacuum sealing techniques. Electrical leads 128 connect the ends 118 and 120 to a power supply 122. Power supply 122 has a first terminal 124 that may be a positive terminal and which is connected to end 120. Power supply 122 has a second terminal 126 that may be a negative terminal and which is connected to end 118. Power supply 122 provides a voltage V that may be a time varying voltage and that may oscillate and reverse polarity periodically in a square wave fashion or with some other suitable waveform.

As an aid to understanding the operation of the embodiment in FIG. 1, temporarily consider an idealized situation wherein the conductive portion 106 of vacuum chamber 104 is considered to be a perfect conductor in a circular path around the portion of the induction core 102. Temporarily consider the power supply 122 to be an idealized voltage source characterized as having zero input or output impedance. When the power supply is connected to the ends 118 and 120 of the conductive portion 106 of the vacuum chamber 104 (and thus also across the non-conducting gap 108 of the vacuum chamber 104), a current given by $dI_O/dt=V/L$ flows in the conductive portion 106, where L, the inductance of the one-turn circuit formed by the conductive portion 106, is determined by the magnetic properties of the induction core 102 composition and geometric aspects of the inductance such as the cross-sectional area of the induction core 102. The boundary conditions imposed by Maxwell's equations demand that the current $I_O$ 130 through the conductive portion 106 be on the outer surface of the conductive portion 106 of the vacuum chamber 104. Inside the vacuum chamber 104 there is no electric or magnetic field as a result of the applied voltage V or the current $I_O$ except in the region of the non-conducting gap 108 where the electric field, $E_G$, is given by geometry to be approximately V/d where d is the gap length d 110 of the non-conducting gap 108. The role of the induction core 102 is to provide a finite inductive impedance that is coupled to the power supply 122, limiting the current $I_O$ 130 by $dI_O/dt=V/L$.

Still considering the idealized situation, a charged particle (charge q) traversing the non-conducting gap 108 in the vacuum chamber 104 will be accelerated with an energy gain of qV. This particle is guided around the induction core 102 inside the vacuum chamber 104 by an appropriate magnetic guide field 134. The particle experiences no retarding fields in the vacuum chamber 104 because all fields (except for the static magnetic guide field as discussed below) are zero except for those induced on the walls by the charge of the particle itself. As the particle travels around the induction core 102 it reenters and traverses the non-conducting gap 108 in the vacuum chamber 104 and its energy is increased by qV again. If it makes n circuits (or turns through the gap) it gains a total energy nqV. The path integral around the inside of the vacuum chamber 104 of E·dl in one complete path is V. Here, E is the electric field in the vacuum chamber 104 and dl represents the path length differential for the beam path (bold quantities are used to represent vectors). E is zero in the conductive portion 106 and is equal to $E_G$ in the non-conducting gap 108. It should be recognized that $E_G$ is a complex function of position in the region of the non-conducting gap and not a constant as implied by the approximate relation $E_G=V/d$. It is not described in detail herein for the purposes of simplifying the discussion. However, regardless of this complex variation, most of the field $E_G$ is located in the vicinity of the non-conducting gap and the path integral of E·dl in one complete path is rigorously V. That is, this electric field has a Curl for its vector character. This distinguishes this electric field from an electrostatic field where the integral of E·dl around a closed path is zero. Conventional means (not shown) are employed for injecting and/or extracting the beam 116 into/from the vacuum chamber 104 according to techniques that will be well known to those familiar with the art.

Thus there are two very distinct electromagnetic field regions in this idealized situation. One is inside the vacuum chamber 104 where the only fields are those created by V in the region of the non-conducting gap 108, those induced by the particle charge q on the inner walls of the conductive portion 106 of the vacuum chamber 104, and those constituting the magnetic guide fields. The other field is outside the conductive portion 106 of the vacuum chamber 104 where the current $I_O$ 130 from $dI_O/dt=V/L$ travels along the outside surface of the conductive portion 106. These two regions are coupled only via the non-conducting gap 108.

Still considering the idealized situation, an induced image charge on the inner surface of the conductive portion 106 of the vacuum chamber 104 forms current $I_I$ 132 and travels along the inner surface in the same direction as the path of the particle(s) in the beam 116. Current $I_I$ 132 is equal to the rate of flow of charge of the particle(s) in magnitude and opposite in sign. When the particle(s) is for example an electron(s) this image charge is positive. When the particle(s) in the beam 116 reaches the end 118 of the conductive portion 106 at the non-conducting gap 108 it simply crosses the non-conducting gap 108 in the vacuum and gains energy qV. However, the induced image charge (and thus the current $I_I$ 132) has no alternative but to come to the outer surface of the conductive portion 106. Upon reaching the outer surface at the end 118, the current $I_I$ 132 travels through electrical leads 128 and through the power supply 122, which has an ideally zero impedance. Thus, in this example, the current $I_I$ 132 resulting from the image charge flows through the power supply 122, electrical leads 128, and enters the inner wall of the conductive portion 106 of vacuum chamber 104 at the end 120, adjacent to the non-conducting gap 108 with the voltage +V and exits at the inner wall of the conductive portion 106 at the end 118, where the voltage is zero, and returns to the power supply 122. The image charge flow provides an additional current $I_I$ 132 flow into the power supply equal to the current flow of the beam 116. The image charge flow is an image current. Thus the power supply provides power to energize the induction core 102 and additionally it provides power to the beam 116 via this coupling with the image charge or image current.

Thus far in this discussion the conductive portion 106 has been considered as ideal with no resistive impedance. In the real (non-idealized) situation, finite resistance must be considered in the working embodiments of this disclosure. This situation is well treated in many texts on electromagnetic theory. Referring to the book by J. D. Jackson ("Classical Electrodynamics", Third Edition, John Wiley & Sons, 1999) the subject is treated in several places. In particular, in Chapters 5 and 8 it is shown that the main effect of the finite conductivity is to localize the currents and fields to a region of the surface called the "skin thickness". This means that fields that vanished at the surface of the idealized perfect conductor now penetrate the real conductor of this working embodiment, but die away as $e^{-x/\delta}$ where x is the distance perpendicular to the surface and δ is the skin thickness. The value of δ depends on the resistivity of the conductive portion 106 of the vacuum chamber 104 and the frequency of the external electromagnetic fields considered. As an example, at 2.5 kHz for copper, δ is approximately 1.3 mm. By assuring that the wall thickness w 112 of the conductive portion 106 is considerably larger than δ, the inner and outer regions of the vacuum chamber remain effectively decoupled electromagnetically. The non-conducting gap 108, however, still causes the flow of the image charge current $I_I$ 132 from the +V side of the power supply 122 into the inner surface of the conductive portion 106 of the vacuum chamber 104 and the flow of the image charge current $I_I$ 132 out of the inner surface of the conductive portion 106 into the low potential side of the power supply 122. In the real situation, the Ohmic resistance to the flow of the current $I_I$ 132 and the current $I_O$ 130 are no longer zero (as in the idealized situation discussed above) in the conductive portion 106, but can be evaluated using standard expressions of current flow through a medium with resistivity ρ with the current distributed in the skin thicknesses of the inner and outer surfaces as described above. Generally, for good conductors such as copper and for geometries and values of δ at the frequencies considered herein, these losses may be low compared to power consumption by other elements.

The coupling of the power supply 122 to the beam 116 in the vacuum chamber 104 through the image charge flowing into the vacuum chamber 104 via the ends 118, 120 of the conductive portion 106 at the non-conducting gap 108 cannot be represented by standard fixed electrical circuit parameters. However, an equivalent electrical circuit can be constructed to illustrate the functional behavior described herein. This is shown in FIG. 2.

Figure 2:
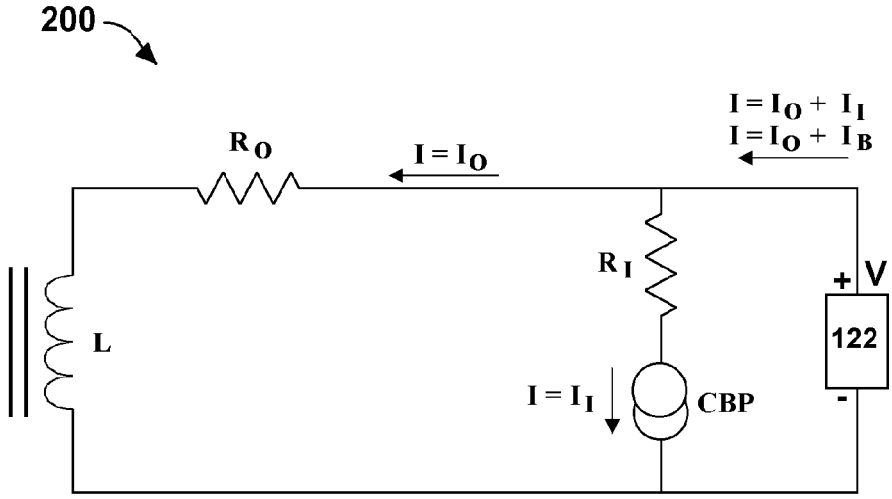
FIG. 2 shows an approximate equivalent circuit of the embodiment shown in FIG. 1.

FIG. 2 is an approximate equivalent circuit schematic 200 of the accelerator shown in FIG. 1. Referring to FIGS. 1 and 2, the inductance of the one-turn coil formed by the conductive portion 106 the vacuum chamber 104 around the induction core 102 is represented by the symbol L in schematic 200. The energy dissipation of the outer surface current $I_O$ 130 due to finite conductivity of the conductive portion 106 is represented by the current, $I_O$, flowing through the resistance $R_O$ in schematic 200. This current, $I_O$, is governed by Equation 1:

$$V-LdI_O/dt-I_OR_O=0 \quad \text{(Equation 1)}$$

(Of course, for the special idealized case where $R_O=0$, as discussed above this reduces to the expression $V-LdI_O/dt=0$, or $dI_O/dt=V/L$. In addition, even when $R_O\neq 0$, for times short compared to $L/R_O$, the relation $dI_O/dt=V/L$ remains sufficiently accurate.) The energy dissipation of the induced image current $I_I$ 132 in the inside of the conductive portion is noted by the current, $I_I$, flowing through a resistance given by the symbol $R_I$ in schematic 200. The symbol CBP denotes the beam coupling of the beam 116 to the power supply 122 via the induced image current $I_I$ 132 on the inside of the conductive portion 106. This induced image current is given by $I_I=I_B$, where $I_B$ is the circulating beam current inside the vacuum chamber 104 due to the beam 116. The image current $I_I$ 132 is supplied by the power supply 122 via the beam coupling CBP through the non-conducting gap 108. The total power supply 122 current is:

$$I=I_O+I_I=I_O+I_B \quad \text{(Equation 2)}$$

Thus the total current from the power supply 122 is the sum of the current $I_o$ 130 exciting a magnetic flux in the induction core 102 and the current $I_B$ due to the beam 116. The power supply 122 supplies energy to the magnetic field in the induction core 102 and to the beam 116. If the beam 116 is not present, only the magnetic energy is supplied. The power supplied by the power supply 122 is given by $P=V(I_O+I_B)$. In any practical situation, the losses due to the dissipation in $R_O$ and $R_I$ are small compared to the dissipation in the magnetic induction core 102 due to hysteresis and internal currents and therefore the Ohmic losses may be neglected. The dissipation in $R_I$ causes a decrease in the energy gain of the circulating beam 116. In general this decrease is much smaller than the qV beam energy gain for each cycle and may again be neglected in terms of beam dynamics except in evaluating the final particle energy.

Referring again to FIG. 1, one exemplary configuration of the accelerator described above is shown. The induction core 102 forms a complete magnetic circuit. The vacuum chamber 104 provides an evacuated region for the beam 116 to circulate about a portion of the induction core 102. The beam 116 is guided by magnetic guide field 134 that constrains all beam orbits to lie within the confines of the vacuum chamber 104. The vacuum chamber 104 (though not necessarily of circular shape) encircles a portion of the induction core 102. The current $I_O$ 130 flows on the outer surface of the conductive portion 106 of vacuum chamber 104. The non-conducting gap 108 has a power supply 122 connected across it. The currents $I_O$ 130 and $I_B=I_I$ 132 flow out of the first (positive) terminal 124 of power supply 122 and into the second (negative) terminal 126 of the power supply 122. In FIG. 1, the power supply 122 presents a voltage V across its terminals 124, 126 as discussed above and the characterization of the first terminal 124 as + and the second terminal 126 as − only implies that the + is at a higher potential than the − terminal when V is positive.

Figure 3:
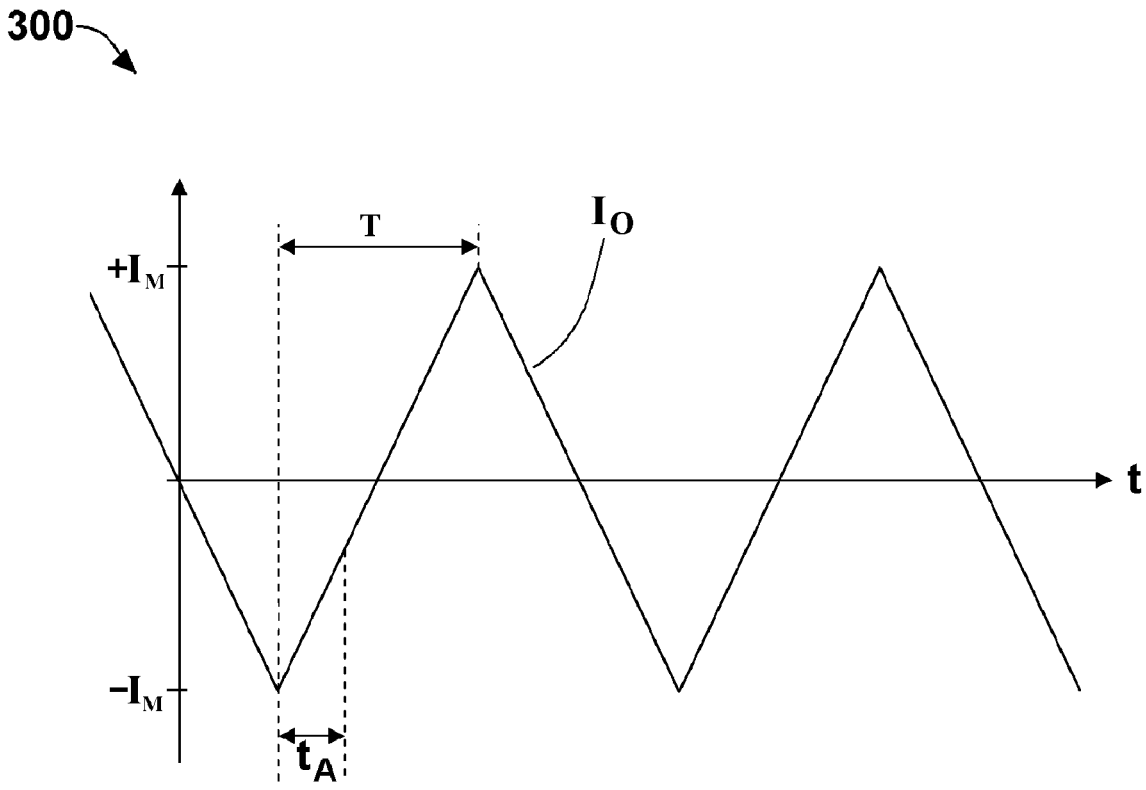
FIG. 3 shows one possible waveform of the current on the outside of the conductive portion of the vacuum chamber for the embodiment shown in FIG. 1.

FIG. 3 shows a graph 300 of one possible current waveform that may be used in an embodiment. Referring to FIG. 3 and to FIG. 1, the voltage V is supplied by a power supply 122 and it may be turned on abruptly and at a constant voltage V. Current $I_O$ grows according to Equation 1 subject to the limit specified by $V/R_O$ and the current $I_O$ is achieved in a time characterized by the time constant $R_O/L$. In the embodiment, the voltage of the power supply 122 may be reversed in polarity to change the direction of $dI_O/dt$ well before this limiting current $V/R_O$ is reached. On each reversal of the voltage V across the conductive portion 106, an acceleration cycle may be completed. The cycle of acceleration may be used on each reversal of the voltage across the non-conducting gap 108 of the vacuum chamber 104. Those skilled in the art will recognize that there are many possible versions of the waveforms for the induction current and voltage driving the system that are appropriate. The explicit choices depend on many factors including the beam duty ratio desired of the design. One mode of operation may involve the magnetic field in the induction core 102 changing from nearly a saturated value in one direction to nearly a saturated value in the opposite direction during one cycle of operation, during which the beam is accelerated to its maximal energy. The voltage driving the system changes from −V to +V at the beginning of this cycle and changes back to −V at the end of this particular cycle. This cycling is illustrated in FIG. 3 where the current $I_O$ is graphed as a function of time. The waveforms shown herein are chosen as exemplary only and those versed in the art will recognize that other waveforms are possible depending on the character of the beam that is desired.

The time for full acceleration is denoted as $t_A$, while the time of one-half cycle is denoted as T. A beam 116 at full energy is available for the time interval $T-t_A$ and the beam 116 at full energy may be continually extracted starting after the acceleration time $t_A$. During the interval T the voltage will be +V across the conductive portion 106 of the vacuum chamber 104 and reverses to −V for times $T<t<2T$ to give the current a negative slope. This cycle can be repeated as often as the acceleration cycle is desired. Of course, it will also be possible, by setting V=0 at any time, to hold a rotating pulse or beam of particles at a fixed energy or range of energies. This may facilitate studies of beam dynamics or the delivery of the beam over an extended period. It will also be recognized by anyone skilled in the art that by reversing the beam injection direction and guide field direction, that acceleration may be achieved during the excursion of the current $I_O$ from −I to +I as well as the excursion from +I to −I, where I is the maximal amplitude of the current $I_O$.

An approximate equivalent circuit of this embodiment is illustrated in FIG. 2. This circuit diagram includes the most important elements for the accelerator and neglects higher order effects that can be corrected for and compensated in the design. One such effect is the interaction of the current $I_O$ 130 via the magnetic field that $I_O$ produces with the magnetic elements (not shown in FIG. 1) that generate the magnetic guide field 134 that guides the beam 116 in the vacuum chamber 104. In one embodiment this interaction is not important because of the inability of the magnetic field to penetrate the magnetic elements, (which may be conductive) during the short times involved between changes in the direction of the current $I_O$. In another embodiment a conductor (not shown) is placed between the vacuum chamber 104 in FIG. 1 and the guide field magnetic elements so as to keep the magnetic field from reaching the guide field magnetic elements. This conductor or the conducting magnetic elements will not form a complete a circuit around the induction core 102. In yet another embodiment the magnetic elements producing the guide field are not conducting (for example, they are constructed of commercially available ferrite materials) and the current $I_O$ 130 produces a magnetic field that couples with the induction core 102 but only minimally with the guide field magnets. This follows because the guide field magnets may be chosen to have a much larger reluctance than the induction core since the guide field magnets have an extensive non-magnetic gap comprised of the vacuum chamber and whatever other non-magnetic spacing is used in a specific geometry. The induction core 102 has no non-magnetic gap. In another embodiment utilizing ferrite materials for the guide magnets, the coupling of $I_0$ to the guide magnets is mitigated by using shorting coils that will prevent the coupling of time varying magnetic fields while not affecting the constant fields of the guide magnets.

Figure 4:
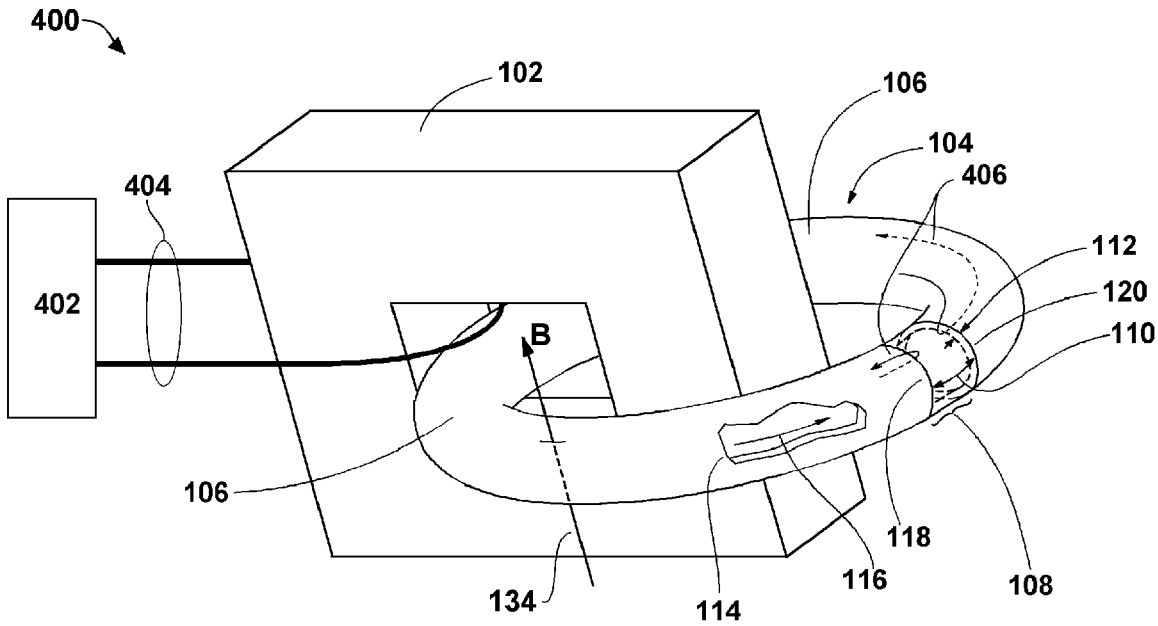
FIG. 4 shows an embodiment with the power supply disposed so as to couple energy to the beam and to the inductive core.

FIG. 4 shows a schematic 400 of another embodiment. The power supply 402 is not connected directly across the non-conducting gap 108 of the vacuum chamber 104 (as was the case in the embodiment shown in FIG. 1). Instead, it is connected to a coil 404 (including one or more turns, depending on design details as will be known to those experienced in the art) around the induction core 102. In this embodiment the vacuum chamber 104 has an electromotive potential generated across its non-conducting gap 108 which is V, just as before. The system acts as a transformer with a one-to-one turn ratio (or a different ratio as those experienced in the art will recognize as possible).

Figure 5:
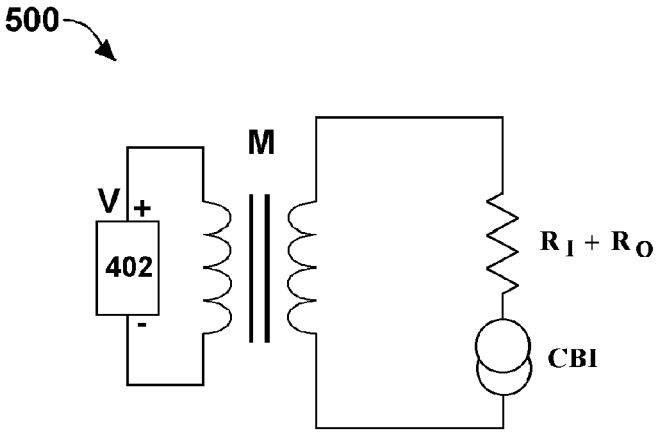
FIG. 5 shows an approximate equivalent circuit of the embodiment shown in FIG. 4.

FIG. 5 shows a schematic 500 of an approximate equivalent circuit of the embodiment shown in FIG. 4. Referring now to FIGS. 4 and 5, the current $I_B$ of the beam 116 will induce a current $I_I$ 406 on the inner wall of the conductive portion 106 of the vacuum chamber 104. This induced current $I_I$ 406 follows the beam particles as they move around the arc of the conductive portion 106 of the vacuum chamber 104 and are an equal current to that of the beam 116 and of opposite sign. As a beam particle crosses the non-conducting gap 108 of the vacuum chamber 104 it will gain an energy qV and continue to be guided around the vacuum chamber 104 by the guide field 134 to repeat the cyclic crossing until the required total energy is acquired. At the end 118 of the conductive portion 106 of the vacuum chamber 104, the induced current $I_I$ 406 encounters the non-conducting gap 108 and must flow to the outer surface from the interior surface of the conductive portion 106 just as in the prior embodiment (FIG. 1). However, in this embodiment, it now flows around the outside surface of the conductive portion 106 of the vacuum chamber 104 to the other end 120 of the conductive portion 106 at the non-conducting gap 108 and re-enters the inside region to flow along the inside surface of the conductive portion 106 of the vacuum chamber 104. This induced current is the coupling of the beam 116 to the power supply 402 via the mutual inductance M of the two coils (coil 404 and the conductive portion 106 of the vacuum chamber 104) coupling the induction core 102. The system acts as a transformer with the particle beam 116 being the current $I_B$ in a one-turn secondary of the transformer. In the standard transformer model the secondary current flows through a resistance that causes dissipation and this power loss is the power required from the power supply 402. In this embodiment the "lost" energy is supplied to the accelerated beam 116 as $P=I_BV$. There is power also supplied to establish the magnetic energy stored in the induction core 102 and to account for the losses in the induction core 102 due to hysteresis and induced currents. Energy can also be lost to the resistance ($R_I$ and $R_O$, defined as before) encountered by the current flowing in the walls of the conductive portion 106 of the vacuum chamber 104 and in the internal impedance of the power supply.

In this embodiment the current in the secondary is determined by the current of the beam 116. This is coupled as an equal current (in the case of a one-to-one turn ratio) in the primary coil 404 connected to the power supply 402. In addition, in the primary coil 404 there is the current required to store magnetic energy in the induction core 102 and the induced losses in the induction core 102. $R_I$ and $R_O$ provide the resistive loss due to the flow of the image current in the walls of the vacuum chamber 104. Losses in the internal impedance of the power supply 402 must also be included. CBI represents the beam coupling of the beam 116 to the induced current $I_I$ 406 flowing in the walls of the conductive portion 106 of the vacuum chamber 104.

The choice between the various embodiments may be based on considerations such as the voltages and currents required to be provided by power supplies, the desired geometric arrangement of system components, cost and electromagnetic shielding.

In all embodiments there are additional couplings of the currents flowing in the walls of the coil and/or conductive portion 106 of the vacuum chamber 104 to the conductive and magnetic guide field elements in the system. These couplings are mitigated by the techniques already discussed such as the use of conductive shields that do not form a closed loop around the induction core 102, yet shield the aforementioned guide elements and the use of non-conducting magnetic materials for the magnets providing the guide fields.

An additional concern is the leakage of magnetic fields from the induction core 102 to nearby magnetic elements such as those forming the guide fields. Such leakage can result if the reluctance of the induction core 102 is not very small compared to that of the leakage paths. As anyone experienced in the art will recognize, this leakage can be reduced by judicious use of conductive shields (not shown) placed between the affected elements and the sources of the fields or by the technique of flux forcing whereby the current driving the induction core 102 is distributed along the length of the induction core 102 by suitably connected conductive material driven in parallel to the conductive portion 106 of the vacuum chamber 104 in the embodiment shown in FIG. 1 and the primary coil 404 in the embodiment shown in FIG. 4. Such modifications as described herein are necessarily specific to the geometry and nature of the materials used in the construction of the embodiment. All of these modifications will be recognized by those experienced in the art and are intended to be a part of this disclosure.

Important to the embodiments in this disclosure are the properties of the magnetic materials used to construct the induction core 102. The functioning of these materials with respect to hysteresis loss and losses due to induced currents affect the performance of the accelerator. Likewise, the permeability of the induction core material and the value of the induction core saturation magnetic flux are important. A high permeability is desirable as is a high saturation flux. The use of amorphous magnetic materials with microcrystalline character and of ferrite materials are included as part of this disclosure to allow the use of high frequency switching of the magnetic field in the induction core 102, but conventional magnetic materials may be used in appropriate applications of this disclosure as well.

Included in the disclosure of these embodiments is the use of magnetic guide fields indicated only schematically in FIGS. 1 and 4 that can encompass a broad range of energies in one region of space. One such method uses the principles of Fixed Field Alternating Gradients (FFAG). There are several FFAG design modalities available such as the so-called scaling and non-scaling varieties. Hybrid systems are possible also. Non-FFAG modalities may also be used depending on cost and performance objectives. It will be recognized by those experienced in the art that the design of such guide fields is well understood and discussed in much literature, some of which is reported in the book by M. S. Livingston and J. P. Blewett cited earlier. All such techniques are encompassed in the scope of the disclosure of these embodiments.

Although the methods and systems have been described relative to specific embodiments thereof, they are not so limited. Obviously many modifications and variations may become apparent in light of the above teachings.

While the systems and methods disclosed herein have been particularly shown and described with references to exemplary embodiments thereof, it will be understood by those skilled in the art that various changes in form and details may be made therein without departing from the scope of the disclosure. It should be realized this disclosure is also capable of a wide variety of further and other embodiments within the spirit of the disclosure. Those skilled in the art will recognize or be able to ascertain using no more than routine experimentation, many equivalents to the exemplary embodiments described specifically herein. Such equivalents are intended to be encompassed in the scope of the present disclosure.

The invention claimed is:

1. A system for accelerating charged particles, comprising:
a) an induction core;
b) a vacuum chamber enclosing an evacuated region;
c) a power supply with associated electrical leads; and
d) at least one magnet disposed to generate a magnetic guide field;
wherein the induction core forms a complete magnetic circuit;
wherein the vacuum chamber encircles a portion of the induction core;
wherein the vacuum chamber comprises an electrically conductive portion and a non-conductive gap;
wherein the at least one magnet is disposed to generate a magnetic guide field suitable to guide charged particles in stable orbits around paths inside the evacuated region enclosed by the vacuum chamber; and
wherein the power supply and associated electrical leads are disposed to provide a voltage across the non-conductive gap of the vacuum chamber.

2. The system of claim 1, further comprising a conducting material disposed to shield the at least one magnet disposed to generate the magnetic guide field.

3. The system of claim 1, wherein the at least one magnet disposed to generate the magnetic guide field is not conducting.

4. The system of claim 3, wherein the at least one magnet disposed to generate the magnetic guide field comprises ferrite materials.

5. The system of claim 1, wherein the magnetic guide field is a fixed field alternating gradient field.

6. The system of claim 1, wherein the induction core comprises a high permeability material.

7. A method of accelerating charged particles, comprising
a) providing
i) an induction core;
ii) a vacuum chamber enclosing an evacuated region;
iii) a power supply with associated electrical leads; and
iv) at least one magnet disposed to generate a magnetic guide field;
wherein the induction core forms a complete magnetic circuit;
wherein the vacuum chamber encircles a portion of the induction core;
wherein the vacuum chamber comprises an electrically conductive portion and a non-conductive gap;
wherein the at least one magnet is disposed to generate a magnetic guide field suitable to guide charged particles in stable orbits around paths inside the evacuated region enclosed by the vacuum chamber; and wherein the power supply and associated electrical leads are disposed to provide a predetermined voltage across the non-conductive gap of the vacuum chamber;

b) generating a magnetic field in the induction core;

c) generating the magnetic guide field suitable to guide charged particles in stable orbits around paths inside the evacuated region enclosed by the vacuum chamber;

d) applying the predetermined voltage across the non-conductive gap by means of the power supply and associated leads;

e) injecting a beam of charged particles into the evacuated region enclosed by the vacuum chamber; and f) permitting the charged particles to circulate in stable orbits around paths inside the evacuated region guided by the magnetic guide field and accelerated by an electrical field induced across the non-conductive gap by the predetermined voltage.

8. The method of claim 7, further comprising extracting at least a portion of the accelerated beam from the evacuated region.

9. The method of claim 7, further comprising providing a conducting material disposed to shield the at least one magnet disposed to generate the magnetic guide field.

10. The method of claim 7, wherein the at least one magnet disposed to generate the magnetic guide field is not conducting.

11. The method of claim 10, wherein the at least one magnet disposed to generate the magnetic guide field comprises ferrite materials.

12. The method of claim 7, wherein the magnetic guide field is a fixed field alternating gradient field.

13. The method of claim 7, wherein the induction core comprises a high permeability material.

* * * * *